US006881085B2

(12) United States Patent
Yahiro et al.

(10) Patent No.: US 6,881,085 B2
(45) Date of Patent: Apr. 19, 2005

(54) CONNECTOR FOR PLATE OBJECT WITH TERMINALS

(75) Inventors: Yasufumi Yahiro, Musashimurayama (JP); Akira Natori, Fussa (JP); Keiichiro Suzuki, Kodaira (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/017,633

(22) Filed: Dec. 7, 2001

(65) Prior Publication Data

US 2002/0072264 A1 Jun. 13, 2002

(30) Foreign Application Priority Data

Dec. 8, 2000 (JP) ..... 2000/374845

(51) Int. Cl.[7] ..... H01R 13/62
(52) U.S. Cl. ..... 439/326; 439/67; 439/632
(58) Field of Search ..... 439/328, 326, 439/630, 631, 632, 492, 493, 67, 77

(56) References Cited

U.S. PATENT DOCUMENTS 3,158,421 A * 11/1964 Hasensuer, Jr. ..... 439/493
3,319,216 A * 5/1967 McCullough ..... 439/493
4,911,643 A * 3/1990 Perry et al. ..... 439/67
5,002,494 A * 3/1991 Olsson ..... 439/77
5,529,502 A * 6/1996 Peltier et al. ..... 439/67
5,803,761 A * 9/1998 Mochizuki ..... 439/326
5,913,699 A * 6/1999 Zielke ..... 439/632
6,012,928 A * 1/2000 Lopata et al. ..... 439/67
6,027,357 A * 2/2000 Howell et al. ..... 439/326
6,176,723 B1 * 1/2001 Sakata et al. ..... 439/326

FOREIGN PATENT DOCUMENTS

JP 04-368788 12/1992
JP 09-320707 12/1997

* cited by examiner

*Primary Examiner*—Hien Vu
(74) *Attorney, Agent, or Firm*—Michael Best & Friedrich LLP

(57) ABSTRACT

In a connector for a small circuit board, contacting means is formed independently of elastic means that provides contact pressure on the small circuit board when the edge portion of the small circuit board is fitted to the connector. The contacting means comprises for example an insulator film and electrical contacts corresponding to terminals of the plate object. The insulator has first and second surfaces and the electrical contacts are formed on the first surface. The elastic means is for example arranged within a housing of the connector. Within the housing, the second surface of the insulator is fixed on the elastic means, so that the electrical contacts are also arranged on the elastic means via the insulator film. When the edge portion of the small circuit board is accommodated within the housing, the elastic means gives the contact pressure to the edge portion of the small circuit board so that the electrical contacts are connected with the terminals of the small circuit board.

7 Claims, 12 Drawing Sheets

CONNECTOR FOR PLATE OBJECT WITH TERMINALS

BACKGROUND OF THE INVENTION

This invention relates to a connector for accommodating therein an edge portion of a plate object and for providing electrical connections to terminals formed on the edge portion of the plate object. The plate object is for example a small circuit board, such as a memory module or the like.

An existing connector for a small circuit board with terminals comprises a housing that has upper and lower planes and an opening between the upper and lower planes. Contacts corresponding to the terminals are regularly arranged within the housing so as to be viewed through the opeing of the housing. In the existing connector, when the edge portion of the small circuit board is inserted into the housing through the opening in a direction slanted against the upper and lower planes of the housing and the small circuit board is then tilted to be substantially parallel with the upper and lower planes of the housing, the contacts and the terminals are connected with each other.

To make the connection reliable, the contacts of the existing connector has elastic characteristic and, by the use of the elastic characteristic, provides contact pressure to the inserted edge portion of the small circuit board when the small circuit board is tilted.

However, as the number of the contacts increases, contact pitches become narrow and the contacts themselves becomes fine and small, because of the limitation of the connector size. The small and fine contacts have smaller elastic characteristic so as not to provide terminals of a small circuit board with contact pressure enough to make reliable connection. In addition, the small and fine contacts are weaker in strength so as to be easily broken if the unexpected force is added to the contacts.

As apparent from the above, a need exists for a connector that, even if contacts of the connector are fine and small, has sufficient structural strength on the contacts and can provide reliable connection.

SUMMARY OF THE INVENTION

The present invention therefore provides a connector for a plate object such as a small circuit board, where contacts are apart from elastic means which provides terminals of the plate object with contact pressure when an edge portion of the plate object is accommodated in a housing of the connector. In other words, contacts are formed independently of the elastic means.

Specifically, a connector according to one aspect of the present invention comprises a housing, an elastic member, a supporter, a film contact, and holding means. The connector accommodates an edge portion of a plate object in the housing and provides electrical connections to terminals of the plate object by the use of the film contact. During the connection, the elastic member provides contact pressure so as to make reliable connection. The terminals are formed on the edge portion of the plate object for example by being printed.

The housing has first and second planes opposite to each other in a first direction. The first and second planes have predetermined space therebetween.

The elastic member is arranged within the predetermined space and on the first plane. The elastic member has a first portion on top thereof in the first direction. When being pushed in the first direction, the first portion causes an elastic reaction force in the first direction.

The supporter is arranged within the predetermined space and on the second plane. The supporter has a second portion on top thereof in the first direction. The second portion is located with an interval left between the first and second portions in a second direction perpendicular to the first direction.

The film contact comprises an insulator film and electrical contacts corresponding to the terminals of the plate object. The insulator film has first and second surfaces, and the electrical contacts are formed on the first surface of the insulator film. The second surface is fixed on the first and second portions so that the electrical contacts are arranged on at least one of the first and second portions via the insulator film. In detail, the electrical contacts are arranged so as to be reliably connected to terminals of the plate object when the plate object is then tilted to substantially parallel with the first and second planes after the edge portion of the plate object is inserted between the first and second portions in a third direction oblique to the first and second directions.

The holding means is for holding parts of the plate object in the first direction when the plate object is tilted and the connection between the electrical contacts and the terminals is established, in order to keep the reliable connection.

With the above structure, the electrical contacts are independent of and apart from the elastic member. Therefore, the connector having the above structure can provides the terminals of the plate object with sufficient contact pressure when the terminals contact on the electrical contacts, so that the reliable connection is achieved even if the electrical contacts are small and fine.

A more complete understanding of the present invention, as well as further features and advantages of the present invention, will be obtained by reference to the following detailed description and drawings.

DESCRIPTION OF PREFERRED EMBODIMENTS

A connector according to a first embodiment of the present invention will now be discussed with reference to FIGS. 1 to 8. The connector 1 of this embodiment is for a plate object 4 such as a small circuit board. Schematically, in the connector 1, electrical contacts (3B) are independent of and apart from elastic means (2F and 2G) which provide terminals (4B) of the plate object 4 with contact pressure when an edge portion (4A) of the plate object 4 is accommodated in a housing 2 of the connector 1.

In detail, the illustrated connector 1 comprises the housing 2 and a film contact 3. In this embodiment, the housing 2 is made of metal, but may be made of other material.

Figure 1:
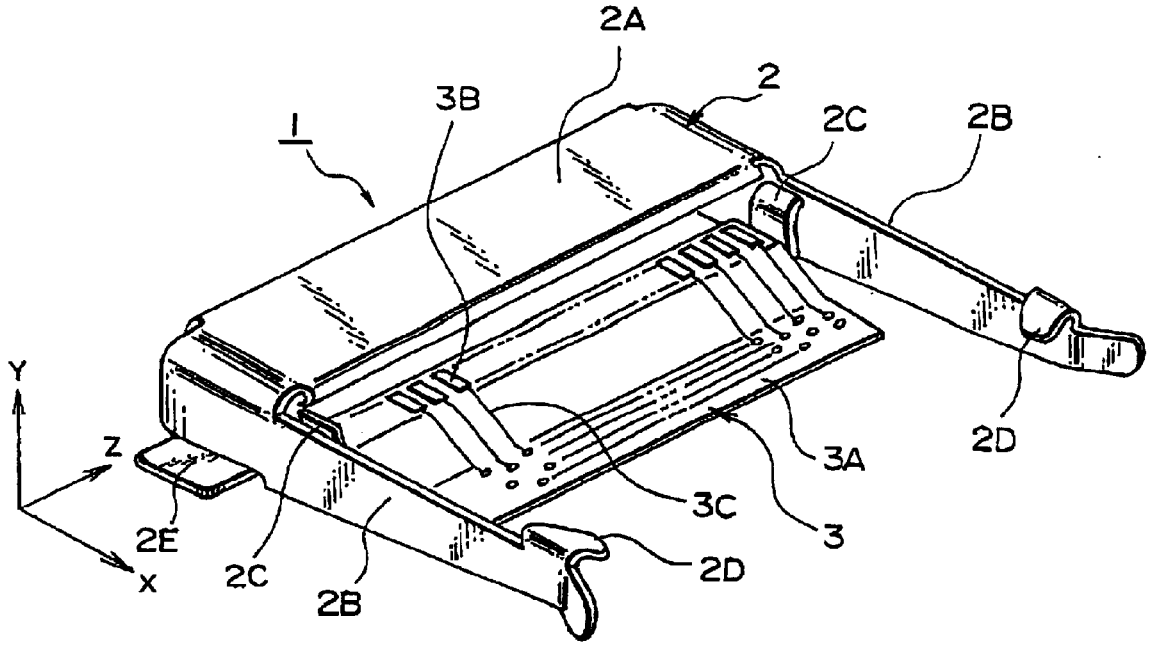
FIG. 1 shows a perspective view of a connector according to an embodiment of the present invention.
Figure 2:
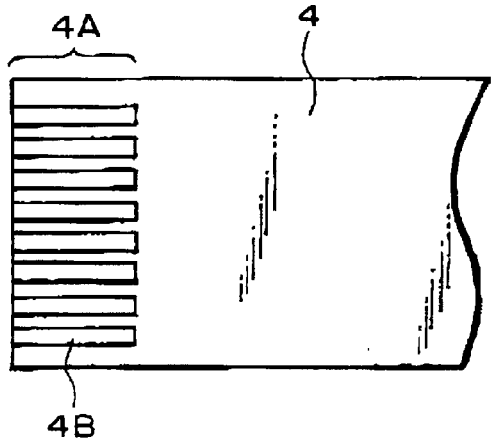
FIG. 2 shows a plane view of a plate object that has an edge portion to be accommodated in the connector shown in FIG. 1.
Figure 4:
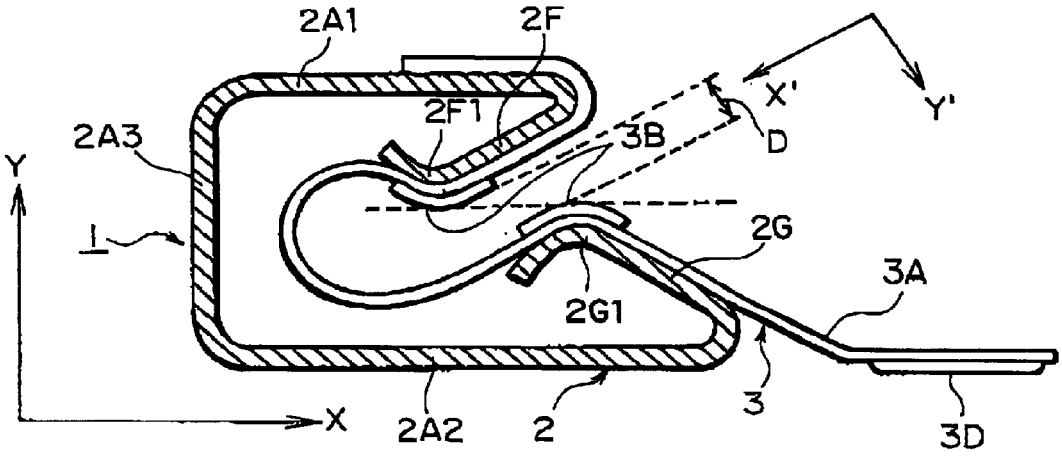
FIG. 4 shows a sectional view of the connector illustrated in FIG. 1.

The housing 2 comprises a body 2A, a pair of arms 2B, a pair of spring pieces 2C, a pair of latch portions 2D, and a pair of tab portions 2E, as shown in FIG. 1. The body 2A comprises a upper plane 2A1, a lower plane 2A2, and a back wall 2A3, as shown in FIG. 4. The upper plane 2A1 and the lower plane 2A2 are opposite to each other in a Y-direction. The arms 2B have plate-like shapes parallel with a plane defined by the Y-direction and an X-direction perpendicular to the Y-direction, as shown in FIG. 1. In addition, the illustrated arms 2B are extended in the X-direction and are opposite to each other in a Z-direction perpendicular to the X- and Y-directions. Parts of the arms 2B serve as the sidewalls of the body 2A so that the body 2A has an opening in the X-direction. In other words, the body 2A defines predetermined space in cooperation with the arms 2B and the opening permits the edge portion 4A of the plate object 4 shown in FIG. 2 to enter into the predetermined space within the housing 2. Herein, the plate object 4 comprises terminals 4B formed on the edge portion 4A. In this embodiment, the terminals 4B are formed on both surfaces of the edge portion 4A, and are of strip type formed by being printed on the edge portion 4A.

The spring pieces 2C are opposite to each other in the Z-direction. When the plate object 4 is set to the connector 1, the spring pieces 2C provide elastic forces on the side of the plate object 4 in the Z-direction so as to sandwich the sides of the plate object 4 in the Z-direction. The latch portions 2D project from the vicinity of the tips of the arms 2B toward inside space between the arms 2B in the Z-direction. The latch portions 2D hook parts of the plate object 4 when the plate object 4 is set to the connector 1. Thus in this embodiment the spring pieces 2C and the latch portions 2D function as holding means when the plate object is fitted in the connector 1. As for the fitting of the plate object 4, an explanation is described later with reference to FIGS. 5 to 8.

The tab portions 2E is for holding the connector 1 down against a board that is not shown and that is for example a mother board. When the tab portions 2E are fixed to the board, the connector 1 is held on the board. Thus the connector 1 according to the present embodiment is of the type which is used and mounted on the board.

The above components of the housing 2, namely, the body 2A, the arms 2B, the spring pieces 2C, the latch portions 2D, and tab portions 2E are integrally formed with each other. In addition, elastic portions 2F and 2G according to the present embodiment are also integrally formed with those components 2A–2E, as shown in FIGS. 3 and 4.

The elastic portions 2F and 2G have comb-like shape projecting within the housing 2 from the edges of the upper plane 2A1 and the lower plane 2A2, respectively. In other words, the elastic portions 2F and 2G are arranged within the predetermined space of the housing 2 and on the upper and lower planes 2A1 and 2A2. The tips of teeth parts of the comb-shaped elastic portions 2F and 2G are bent so that first and second portions 2F1 and 2G1 are formed on the top of the elastic portions 2F and 2G in the Y-direction. The first portions 2F1 is away from the second portions 2G1 in the X-direction, that is to say, an interval is left between the first and second portions 2F1 and 2G1 in the X-direction. When being pushed in the Y-direction, the first and second portions 2F1 and 2G1 cause elastic reaction forces in the Y-direction. The elastic reaction force of the first portions 2F1 reacts on an opposite orientation to the other elastic reaction force of the second portions 2G1.

Figure 3:
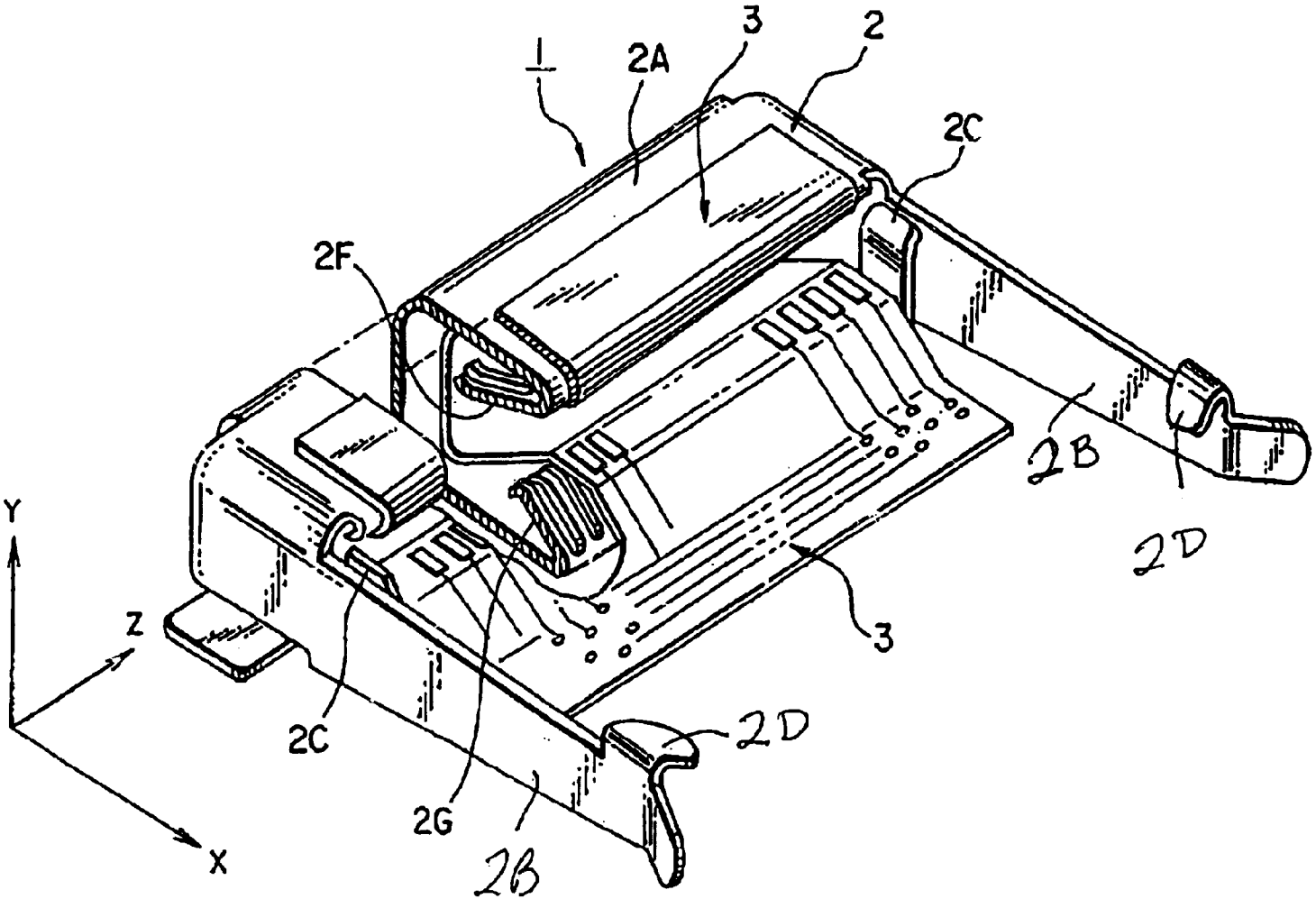
FIG. 3 shows a partial sectional and perspective view of the connector illustrated in FIG. 1.

The film contact 3 comprises an insulator film 3A and electrical contacts 3B corresponding to the terminals 4B of the plate object 4, as shown in FIGS. 1, 3 and 4. The insulator film 3A has first and second surfaces and the electrical contacts 3B are formed on the first surface of the insulator film 3A. Referring to FIG. 4, the second surface of the insulator film 3A is fixed on the first and second portions 2F1 and 2G1 so that the insulator film 3A forms a blind alley within the predetermined space of the housing 2 in a cross section defined by the X- and Y-directions. The fixing of the insulator film 3A to the first and second portions 2F1 and 2G1 results in that the electrical contacts 3B are regularly arranged on both the first and second portions 2F1 and 2G1 via the insulator film 3A, as shown in FIG. 4. In other words, if the electrical contacts 3B are assumed to be regularly arranged in specific lines on the first surface of the insulator film 3A, parts of the second surface corresponding to the specific lines are fixed on the first and second portions 2F1 and 2G1.

In addition, where the plate object 4 has a predetermined thickness D, the first and second portions 2F1 and 2G1 are located so as to have in the Y-direction a first interval less than the predetermined thickness D of the plate object 4 and to have in an Y'-direction a second interval slightly wider than the predetermined thickness D of the plate object 4, the Y'-direction being perpendicular to an X'-direction that is an insertion direction of the edge portion 4A of the plate object 4. Specifically, in this embodiment, the first interval is substantially equal to zero while the second interval is substantially equal to a interval that is D+twice thickness of the electrical contacts 3B, shown in FIG. 4. In other words, the second interval is slightly wider than the thickness D of the plate object 4 by the twice thickness of the electrical contacts 3B.

The film contact 3 further comprises wires 3C and soldered pads 3D as shown in FIG. 1 and 4. The illustrated wires 3C are connected to the electrical contacts 3B, respectively, and are formed on the first surface of the insulator film by being printed in a similar way of the electrical contacts 3B. The soldered pads 3D are formed on the second surface of the insulator film 3A while connected to the wires 3C, respectively, through the insulator film 3A, so as to be connected to the electrical contacts 3B. When the connector 1 is mounted on the board by the use of the tab portions 2E of the housing 2, the soldered pads is connected to predetermined connection points of the board so that the predetermined connection points are connected to the electrical contacts 3B.

With the above structure, the electrical contacts 3B make good connection with the terminals 4B of the plate object 4 when the plate object is fitted to the connector 1. Thus the terminals 4B of the plate object 4 are reliably connected to the predetermined connection points of the board on which the connector a mounted.

With reference to FIGS. 5 to 8, an explanation will be made about an operation of the connector 1 or how to fit the plate object 4 to the connector 1.

Figure 6:
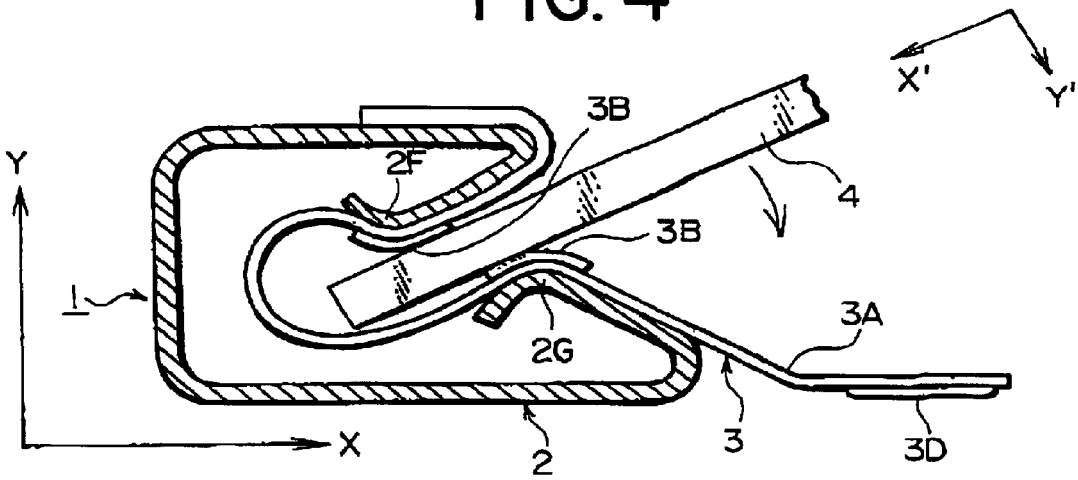
FIG. 6 is a sectional view for use in describing an operation of the connector illustrated in FIG. 1.
Figure 5:
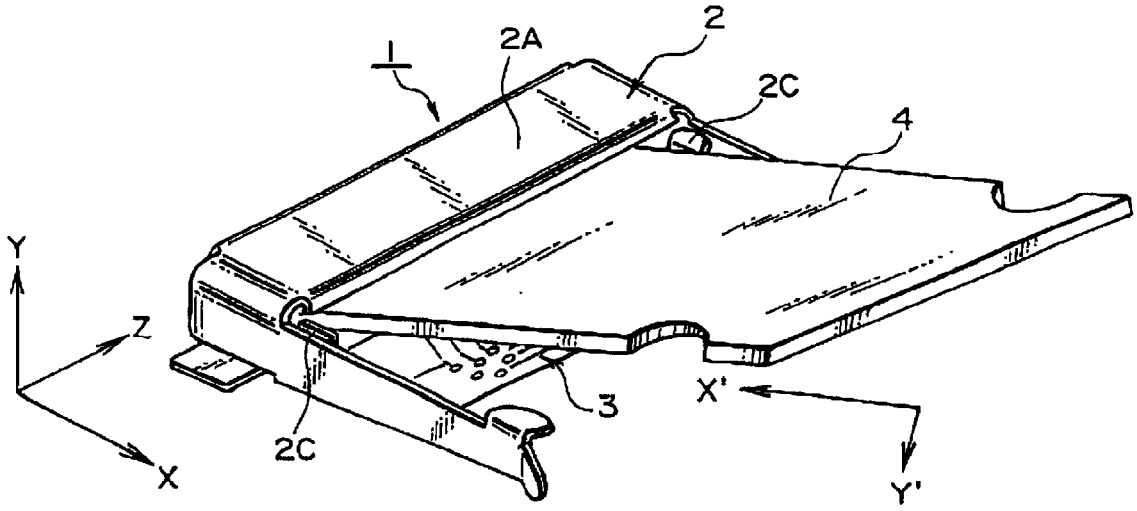
FIG. 5 is a perspective view for use in describing an operation of the connector illustrated in FIG. 1.

As shown in FIGS. 5 and 6, the edge portion 4A of the plate object 4 is inserted in the X'-direction oblique to the X- and Y-directions and between the electrical contacts 3B formed on the first and second portions 2F1 and 2G1. At this time, the elastic portions 2F and 2G have not generated elastic forces yet, and the electrical contacts 3B lightly contact on the terminal 4B of the plate object 4.

Figure 8:
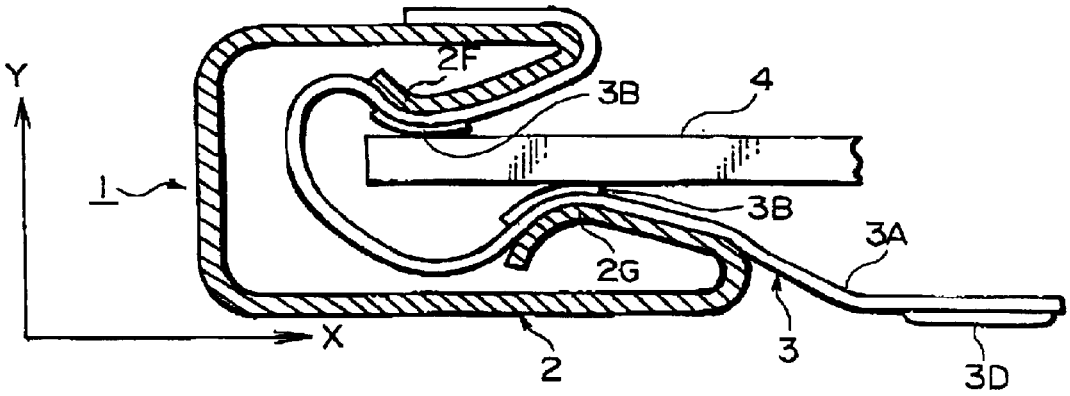
FIG. 8 is a sectional view for use in describing an operation of the connector illustrated in FIG. 1.
Figure 7:
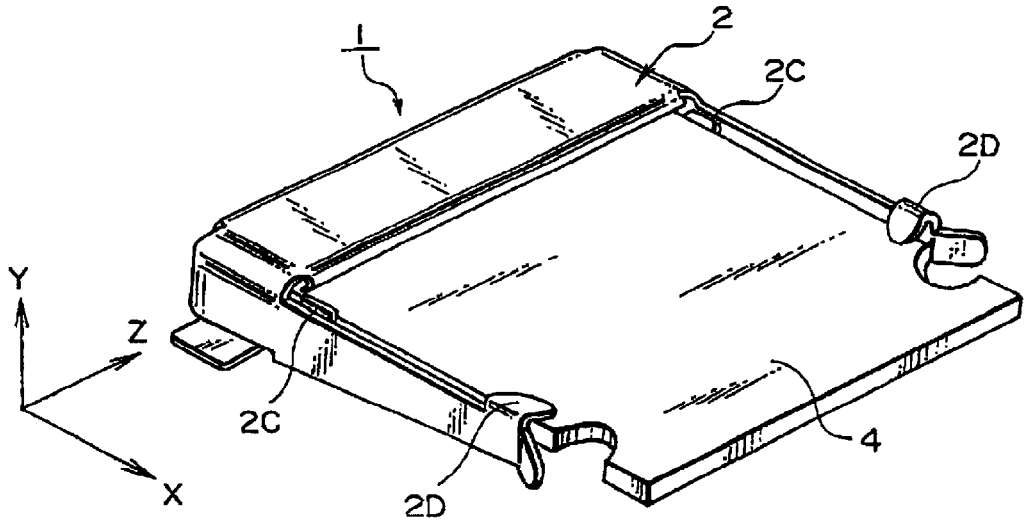
FIG. 7 is a perspective view for use in describing an operation of the connector illustrated in FIG. 1.
Figure 9:
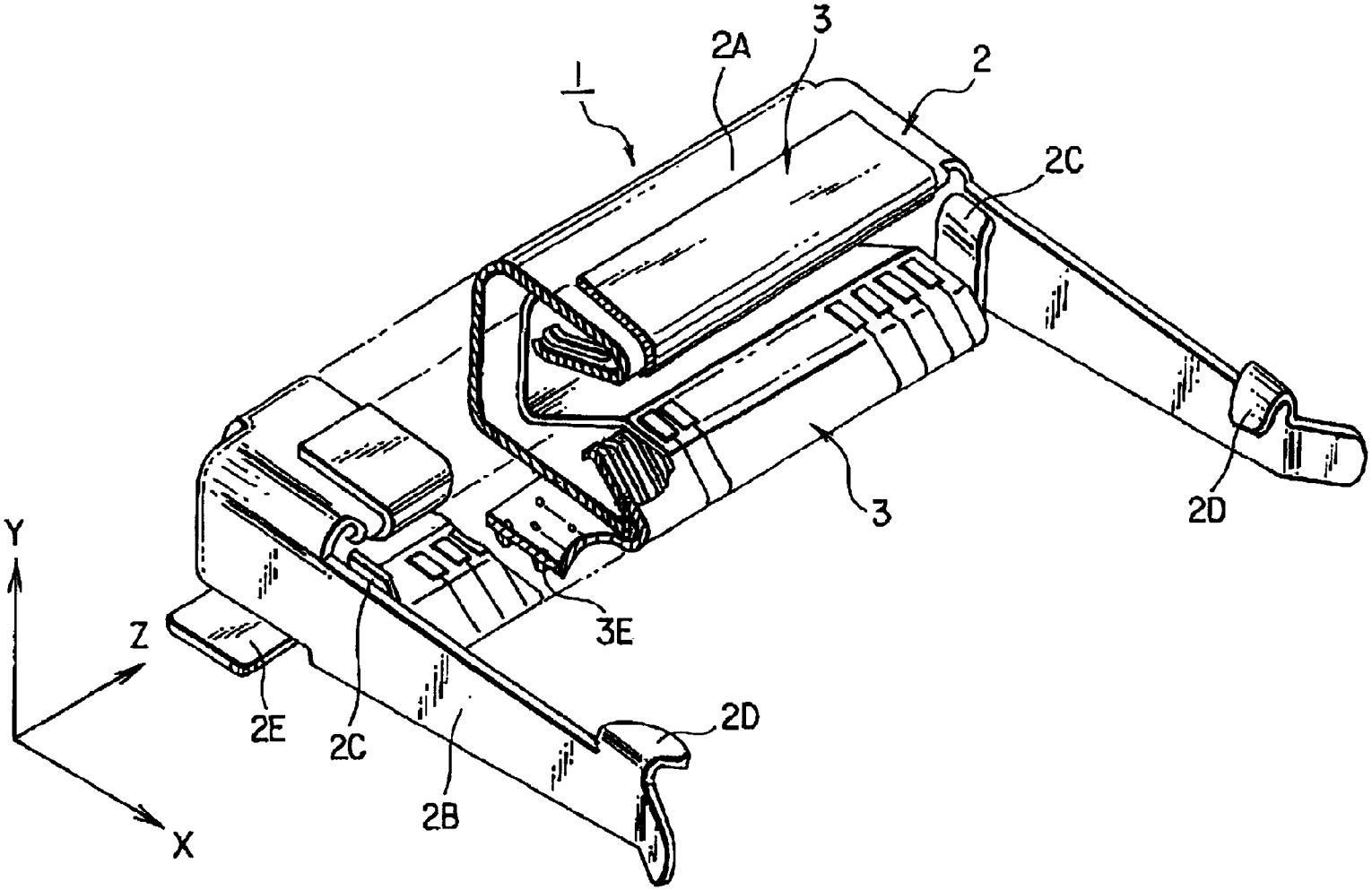
FIG. 9 shows a partial sectional and perspective view of a connector according to another embodiment of the present invention.
Figure 10:
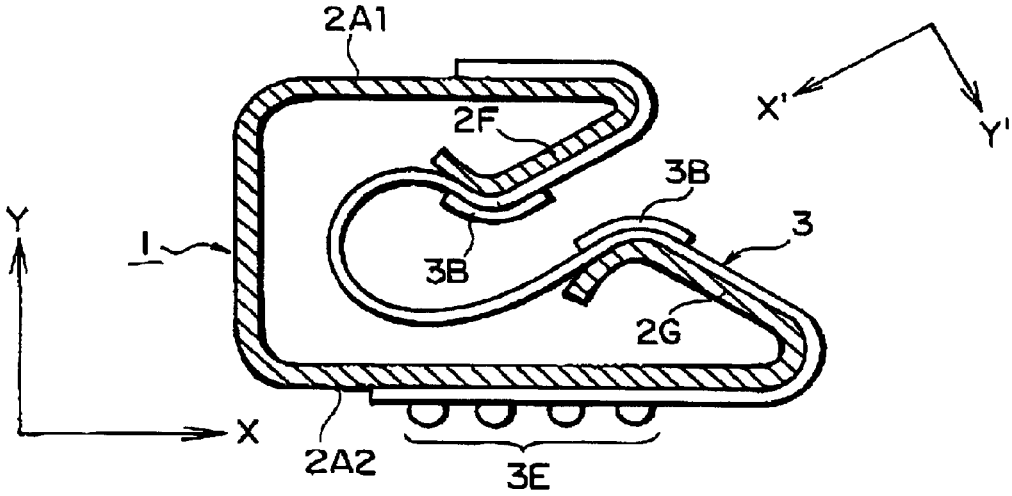
FIG. 10 shows a sectional view of the connector illustrated in FIG. 9.

Then the plate object 4 is tilted to be substantially parallel with the upper and lower planes 2A1 and 2A2, as shown in FIGS. 7 and 8. The tilting provides forces to the first and second portions 2F1 and 2G1 via the film contact 3 in the Y-direction. The forces in the Y-direction cause the elastic portions 2F and 2G to generate the elastic reaction forces in the Y-direction. The elastic reaction forces serve good contact pressure so that the reliable connection between the electrical contacts 3B and the terminals 4B is obtained.

To keep the good connection state, the spring pieces 2C sandwich both sides of the plate object 4 in the Z-direction and the latch portions 2D hook parts of the plate object 4 in the Y-direction. Thus the plate object 4 is fitted to the connector 1 with the good connection condition.

Now, an explanation will be made about a second embodiment of the present invention with reference to FIGS. 9 to 12.

As apparent from FIGS. 1 to 8 and FIGS. 9 to 12, the second embodiment is a modification of the first embodiment mentioned above, and both embodiments are similar to each other except as a film contact 3. In FIGS. 1 to 8 and FIGS. 9 to 12, the common numerical references are labeled to the components in the connector of the second embodiment and the components in the connector of the first embodiment, where the respective components in both connectors have similar structure and function in the similar way. Therefore the explanations about the similar components are omitted for the sake of clarity.

The film contact 3 comprises, as ball grid array (BGA), a plurality of connection balls 3E made of material such as solder, instead of the soldered pads 3D. The connection balls 3E are formed on the first surface of the insulator film where the electrical contacts 3B and wires connected to the electrical contacts 3B are formed. The connection balls 3E are also connected to the electrical contacts 3B through the wires. A partial area of the insulator film where the connection balls 3E are arranged is bent or folded at a line corresponding to the edge line of the lower surface 2A2 in the X-direction, so that the connection balls 3E face downward, namely, face the board when the connector 1 is mounted on the board.

Figure 11:
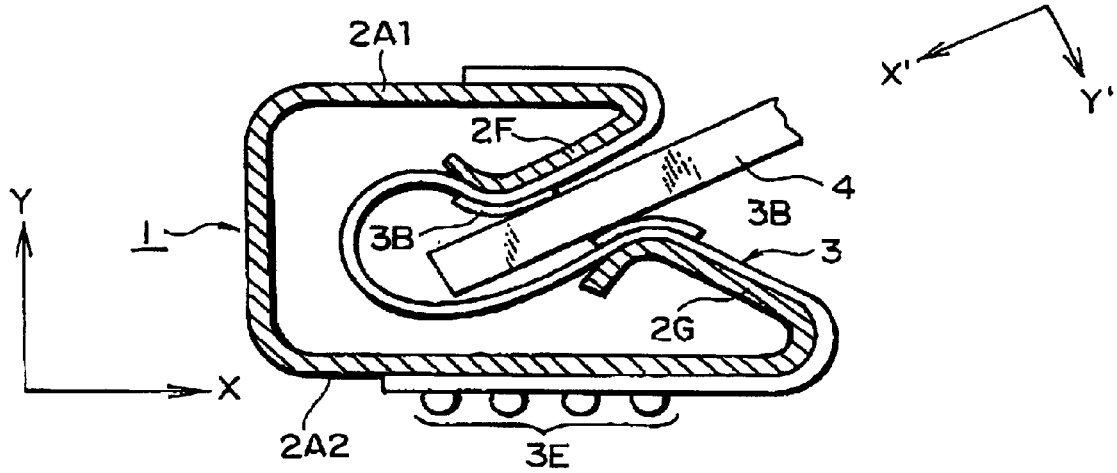
FIG. 11 is a sectional view for use in describing an operation of the connector illustrated in FIG. 9.
Figure 12:
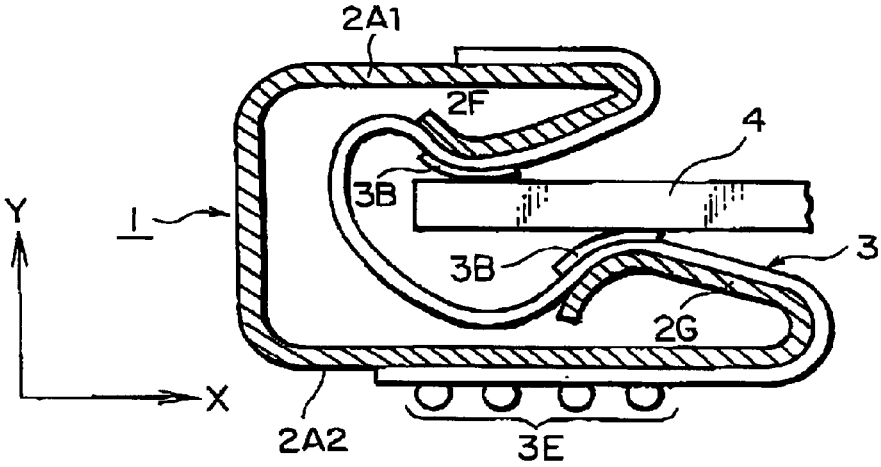
FIG. 12 is a sectional view for use in describing an operation of the connector illustrated in FIG. 9.

With the above structure, the electrical contacts 3B make good connection with the terminals 4B of the plate object 4 when the plate object is fitted to the connector 1. In detail, the good connection is obtained in the similar way of the first embodiment, as described below. As shown in FIG. 11, the edge portion 4A of the plate object 4 is inserted between the electrical contacts 3B in the X'-direction. At this time, the elastic portions 2F and 2G have not generated elastic forces yet, and the electrical contacts 3B lightly contact on the terminal 4B of the plate object 4. Then the plate object 4 is tilted to be substantially parallel with the upper and lower planes 2A1 and 2A2, as shown in FIGS. 12. The tilting provides forces to the elastic portions 2F and 2G via the film contact 3 in the Y-direction. The forces in the Y-direction cause the elastic portions 2F and 2G to generate the elastic reaction forces in the Y-direction. The elastic reaction forces serve good contact pressure so that the reliable connection between the electrical contacts 3B and the terminals 4B is obtained. To keep the good connection state, the spring pieces 2C sandwich both sides of the plate object 4 in the Z-direction and the latch portions 2D are engaged with parts of the plate object 4 in the Y-direction. Thus the plate object 4 is fitted to the connector 1 with the good connection condition.

Figure 13:
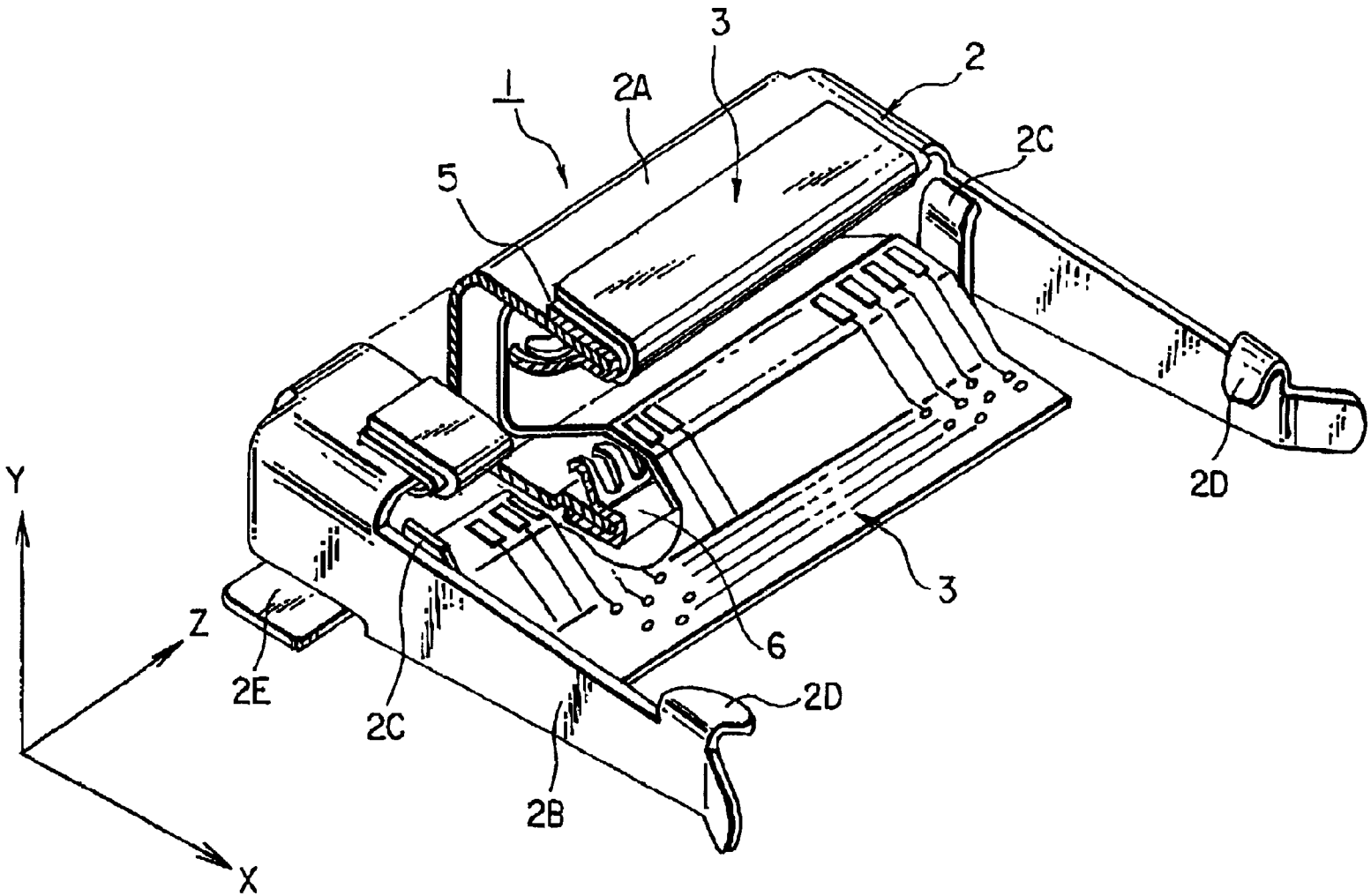
FIG. 13 shows a partial sectional and perspective view of a connector according to another embodiment of the present invention.
Figure 14:
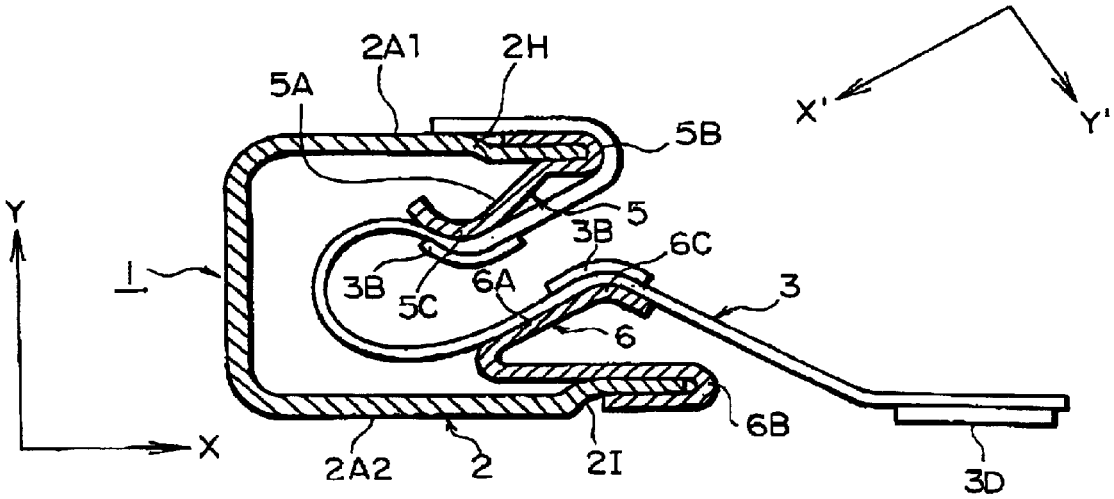
FIG. 14 shows a sectional view of the connector illustrated in FIG. 13.

Now, an explanation will be made about a third embodiment of the present invention with reference to FIGS. 13 and 14.

As apparent from FIGS. 1 to 8 and FIGS. 13 and 14, the third embodiment is a modification of the first embodiment mentioned above, and both embodiments are similar to each other except as elastic member (2F, 2G and 5, 6). In FIGS. 1 to 8 and FIGS. 13 and 14, the common numerical references are labeled to the components in the connector of the third embodiment and the components in the connector of the first embodiment, where the respective components in both connectors have similar structure and function in the similar way. Therefore the explanations about the similar components are omitted for the sake of clarity.

The connector 1 according to the third embodiment comprises elastic members 5 and 6, instead of the elastic portions 2F and 2G in the first embodiment. Both the elastic members 5 and 6 in the third embodiment are discrete parts and are separated from the housing 2, that is to say, are not integrally formed with the housing 2. The elastic members 5 is obtained by bending a single plate made of material such as metal and comprises an elastic portion 5A and a U-shaped portion 5B. On the top of the elastic portion 5A, the elastic members 5 has a first portion 5C. Similarly, the elastic portion 6 comprises an elastic portion 6A with a second portion 6C and a U-shaped portion 6B.

The U-shaped portions 5B and 6B are for fitting the elastic members 5 and 6 to the upper and lower planes 2A1 and 2A2 at the edges of the planes 2A1 and 2A2 in the X-direction. For the fitting, the edges of the upper and lower planes 2A1 and 2A2 is cranked so as to have step-like portions 2H and 2I. Due to the step-like portions 2H and 2I, the U-shaped portions 5B and 6B do not project from the upper and lower planes 2A1 and 2A2 in the Y-direction when being fitted to the upper and lower planes 2A1 and 2A2.

The connector 1 of the present embodiment can also be operated in the similar way of the first embodiment, and can make good connection with the terminals 4B of the plate object 4 when the plate object is fitted to the connector 1. When the edge portion 4A of the plate object 4 is inserted along the X'-direction and between the electrical contacts 3B formed on the first and second portions 5C and 6C, and the plate object 4 is then tilted to be substantially parallel with the upper and lower planes 2A1 and 2A2, the reliable connection between the electrical contacts 3B and the terminals 4B can be obtained. In addition, for keeping the good connection state, the spring pieces 2C and the latch portions 2D also function in the similar way of the first embodiment. Thus the plate object 4 is fitted to the connector 1 with the good connection condition.

Figure 15:
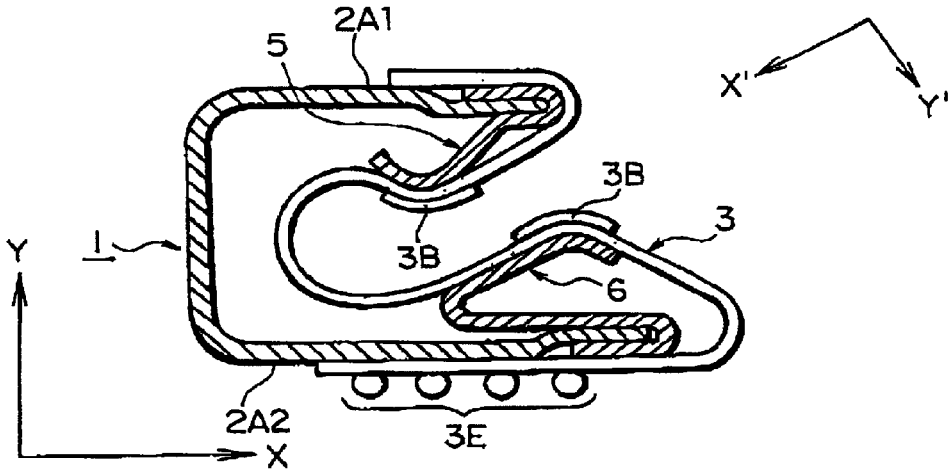
FIG. 15 shows a sectional view of a modification of the connector illustrated in FIG. 13.

The connector 1 according to the third embodiment may be modified as shown in FIG. 15. That it, in this embodiment, the film contact 3 may be adopt "BGA" structure 3E similarly to the second embodiment.

Figure 16:
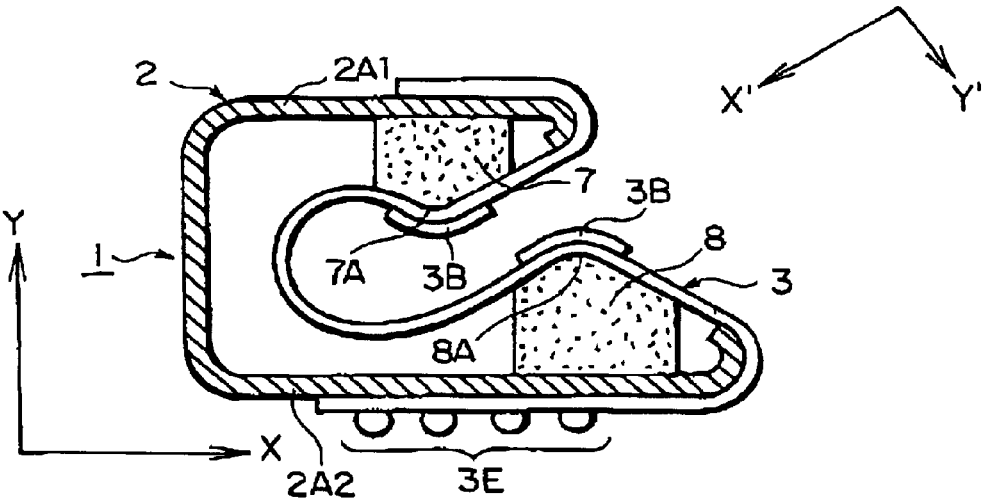
FIG. 16 shows a sectional view of a connector according to another embodiment of the present invention.
Figure 17:
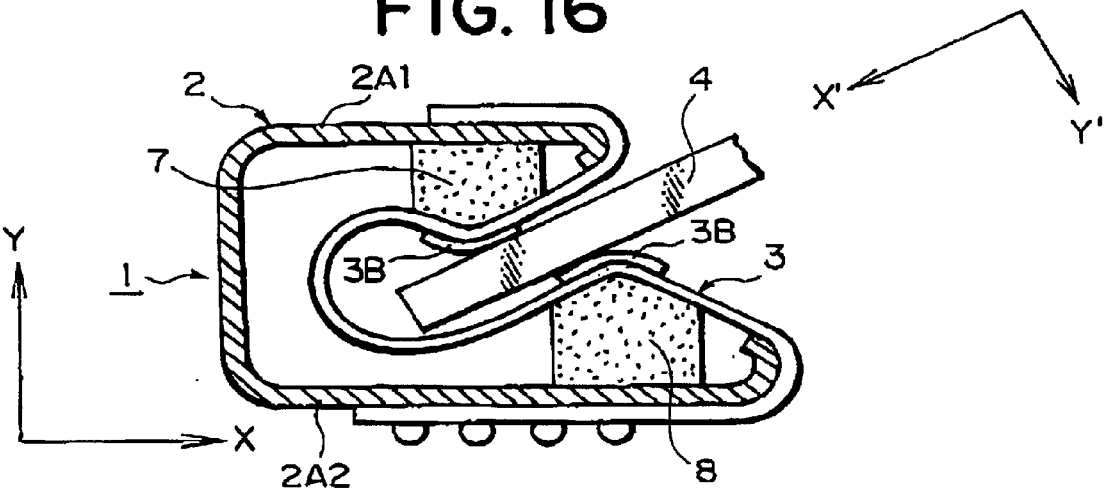
FIG. 17 is a sectional view for use in describing an operation of the connector illustrated in FIG. 16.
Figure 18:
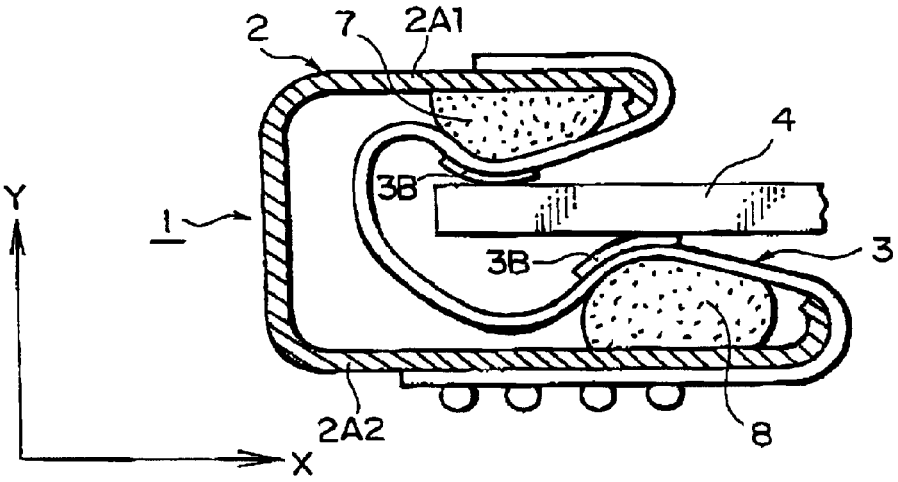
FIG. 18 is a sectional view for use in describing an operation of the connector illustrated in FIG. 16.

With reference to FIGS. 16 to 18, a connector according to a fourth embodiment of the present invention will now be discussed below. The fourth embodiment is a modification of the second embodiment mentioned above, and both embodiments are similar to each other except as elastic members (2F, 2G and 7,8). In FIGS. 9 to 12 and FIGS. 16 to 18, the common numerical references are labeled to the components in the connector of the fourth embodiment and the components in the connector of the second embodiment, where the respective components in both connectors have similar structure and function in the similar way. Therefore the explanations about the similar components are omitted for the sake of clarity.

The connector 1 according to the fourth embodiment comprises elastic members 7 and 8 made from rubber, instead of the elastic members 5 and 6. That is the elastic members 7 and 8 are rubber block having in the Y-direction first and second portions 7A and 8A on the top thereof, respectively. Both the elastic members 7 and 8 of this embodiment are also discrete parts and are apart from the housing 2, that is to say, are not integrally formed with the housing 2. In a cross section defined by the X- and Y-directions, the elastic members 7 and 8 have substantially pentagonal shapes where two opposite edges (planes) in the Y'-direction define the insertion direction of the X'-direction.

The connector 1 of the fourth embodiment can also be operated in the similar way of the second embodiment, and can make good connection with the terminals 4B of the plate object 4 when the plate object is fitted to the connector 1. When the edge portion 4A of the plate object 4 is inserted along the X'-direction and between the electrical contacts 3B formed on the first and second portions 7A and 8A (See FIG. 17), and the plate object 4 is then tilted to be substantially parallel with the upper and lower planes 2A1 and 2A2 (See FIG. 18), the elastic members 7 and 8 are pressed and transformed into non-cornered shapes shown in FIG. 18, so that the reliable connection between the electrical contacts 3B and the terminals 4B can be obtained. In addition, for keeping the good connection state, the spring pieces and the latch portions also function in the similar way of the second embodiment. Thus the plate object 4 is fitted to the connector 1 with the good connection condition.

A general description of the present invention as well as a preferred embodiment of the present invention has been set forth above. Those skilled in the art to which the present invention pertains will recognize and be able to practice additional variations in the connectors described which fall within the teachings of this invention.

For example, although the two elastic parts (2F, 2G, 5, 6, 7, 8) are arranged within the housing 2 in the preferred embodiments of the present invention, only ones of the two parts (2F, 5 and 7, or 2G, 6 and 8) may be elastic while the other ones may not be elastic. That is, ones of two parts (2F, 5 and 7, or 2G, 6 and 8) may be simple supporters.

Elastic means providing contact pressure may be other elastic members except for the exemplified elastic means (2F, 2G, 5, 6, 7, 8). However, preferably the elastic means has elastic characteristic not only in the Y-direction but also in the X-direction, as exemplified in the above descriptions, because of a moment according to the tilting or the rotation of the plate object 4.

Figure 19:
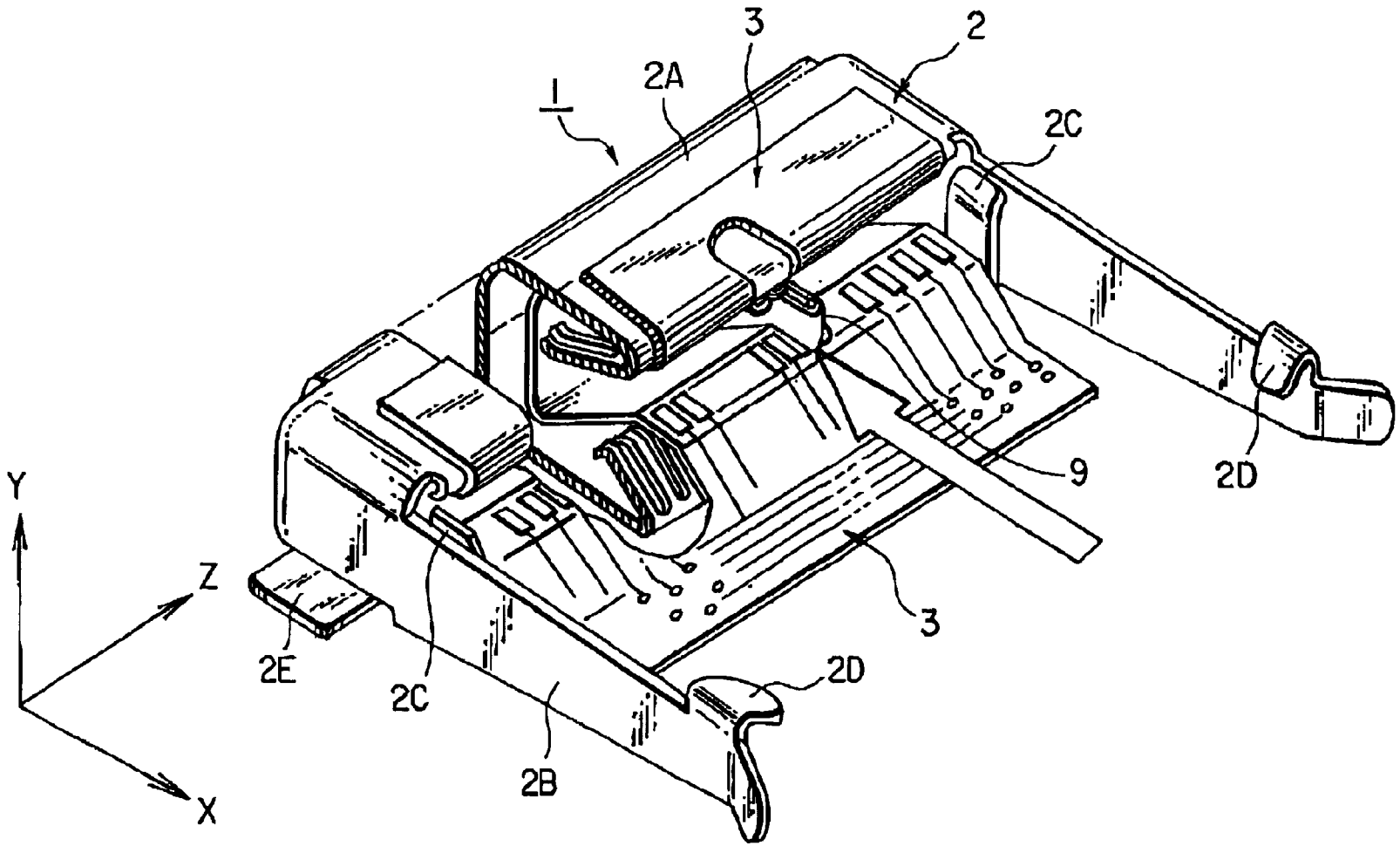
FIG. 19 is a partial sectional and perspective view of a modification of the connector illustrated in FIG. 1.

The connector 1 may further comprise a guide key 9, as shown in FIG. 19, if the plate object 4 has a guide keyway on the edge thereof. The guide key 9 is formed within the housing 2 and corresponds to the guide keyway of the plate object 4. In the illustrated connector 1, the guide key 9 is integrally formed with the housing 2. In the movable range of the plate object 4 during the fitting thereof, the guide key 9 has the same cross sectional shape in any planes perpendicular to the plane defined by the X- and Y-directions. For example, if the guide keyway has the rectangular shape, the guide key 9 also has the sectional rectangular shape in the movable range of the plate object 4 so that the plate object 4 is suitably guided by the guide key 9 and the guide keyway and is smoothly fitted to the connector 1. In addition, the guide key 9 and the guide keyway may be formed at positions except for the center positions in the Z-direction. In this case, the insertion of the plate object 4 is carried out without mistake as for the insertion head and the front and back surfaces of the plate object 4.

Figure 20:
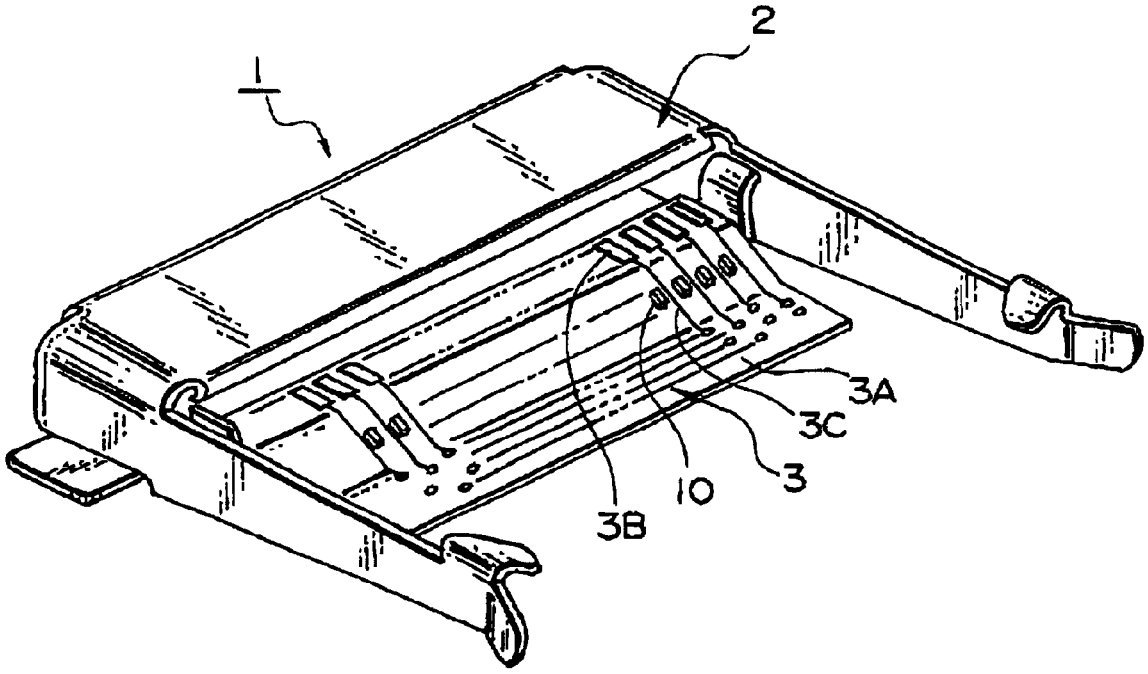
FIG. 20 is a perspective view of another modification of the connector illustrated in FIG. 1.
Figure 21:
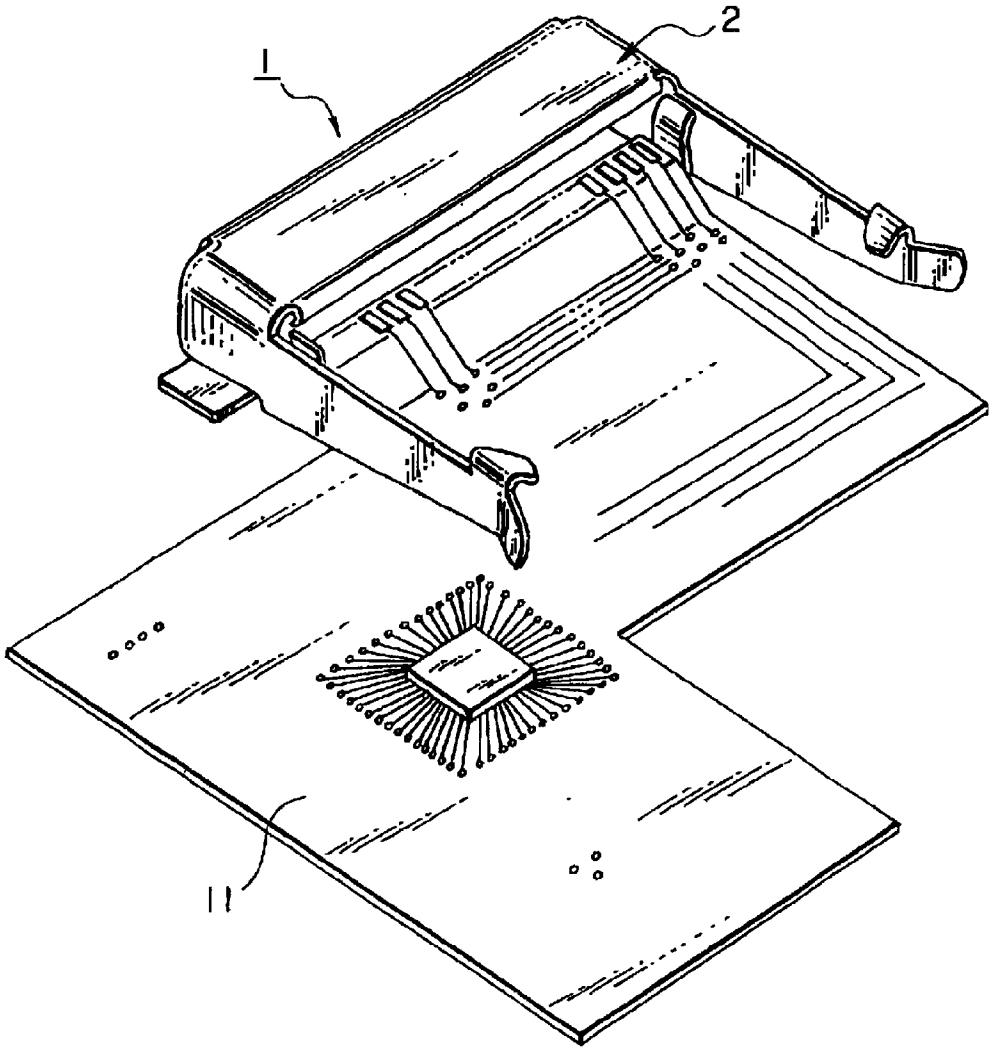
FIG. 21 is a perspective view of another modification of the connector illustrated in FIG. 1.

One or more IC components 10 may be arranged on the insulator film 3A of the film contact 3, as shown in FIG. 20. In the illustrated FIG. 20, the IC components 10 are arranged on one surface of the insulator film 3A and are not connected to the wires 3C. Although the film contact is a discrete part in the above-mentioned embodiments, a film contact may be formed as a part of a flexible printed circuit 11 as shown in FIG. 21.

All such modifications and additions are deemed to be within the scope of the invention which is to be limited only by the claims appended hereto.

This application is based on Japanese Patent Application filed on Dec. 8, 2000, No. 2000-374845, and those claims, specification and drawings are incorporated herein by reference.

What is claimed is:

1. A connector for accommodating therein an edge portion of a plate object and for providing electrical connections to terminals formed on the edge portion of the plate object, comprising:

a housing made of metal and having first and second planes opposite to each other in a first upward direction to the first plane with a space left therebetween, the first and second planes having a predetermined space therebetween;

an elastic member arranged within the predetermined space and connected to the first plane, the elastic member having a first curved portion extended at one end; the first curved portion, when being pushed in the first direction, causing first elastic reaction force in an opposite direction opposite to the first direction;

an elastic supporter arranged within the predetermined space and connected to the second plane, the elastic supporter having a second curved portion, the second curved portion being spaced from the first curved portion in a second downward direction to the second plane; perpendicular to the first direction, the second curved portion, when being pushed in the first direction, causing second elastic reaction force in the opposite direction;

a film contact comprising an insulator film and electrical contacts corresponding to the terminals of the plate object, the insulator film extending from a top surface of the first plane into; the first portion of the elastic member, the space between the first and second planes, and the second portion of the elastic supporter and having first and second surfaces, the electrical contacts being formed on the first surface of the insulator film, the second surface being fixed on the first and second portions so that the electrical contacts have first and second contacts arranged on the first and second portions via the insulator film, respectively, the film contact further comprising wires extending along the first surface of the insulator film and connected to the first and second contacts, respectively, and, when the edge portion of the plate object is inserted between the first and second portions in a third direction oblique to the first and second directions and the plate object is then tilted to be substantially parallel with the first and second planes, are connected to terminals of the plate object with being in press contact with the terminals by a combination of the first elastic reaction force and the second elastic reaction force;

two arms opposite to each other in a direction perpendicular to the first and second directions, the arms being integrally formed with at least one of the first and second planes and being extended outwardly therefrom;

a pair of spring connected to the two arms pieces opposite to each other in direction perpendicular to the first and second directions, the spring nieces having elastic forces so as to elastically sandwich the plate object therebetween in the direction when the plate object is tilted to be substantially parallel with the first and second planes; and holding means for holding the plate object in the first direction to maintain a state where the plate object is sandwiched by the spring pieces.

2. A connector as claimed in claim 1, wherein the supporter is an elastic member which when the second portion is pushed in the first direction causes an elastic reaction force in the first direction.

3. A connector as claimed in claim 1, wherein the housing further comprising:

two arms opposite to each other in a particular direction perpendicular to the first and second directions, the arms being integrally formed with at least one of the first and second planes and being extended in the second direction; and two latch portions which are integrally formed with arms, respectively, and which project toward inside space between the two arms so as to serve as the holding means by hooking parts of the plate object when the plate object is tilted to be substantially parallel with the first and second planes.

4. A connector as claimed in claim 1, wherein the elastic member and the supporter are integrally formed with the first and second planes, respectively.

5. A connector as claimed in claim 1, further comprising tab portions which are integrally formed with the housing and which are fixed on a board so that the connector is held on the board.

6. A connector as claimed in claim 1, the plate object having a guide keyway on the edge thereof, further comprising a guide key corresponding to the guide keyway so as to guide the plate object in cooperation with the guide keyway when the edge portion of the plate object is inserted into the predetermined space. A connector as claimed in claim 1, the plate object having a guide keyway on the edge thereof, further comprising a guide key corresponding to the guide keyway so as to guide the plate object in cooperation with the guide keyway when the edge portion of the plate object is inserted into the predetermined space.

7. A connector as claimed in claim 6, wherein the guide key is integrally formed with the housing.

* * * * *

UNITED STATES PATENT AND TRADEMARK OFFICE

CERTIFICATE OF CORRECTION

PATENT NO. : 6,881,085 B2 
DATED : April 19, 2005
INVENTOR(S) : Yasufumi Yahiro, Akira Natori and Keiichiro Suzuki It is certified that error appears in the above-identified patent and that said Letters Patent is hereby corrected as shown below:

Title page,
Item [56], References Cited, U.S. PATENT DOCUMENTS, delete "Hasenuer, Jr." and replace with -- Hasenauer, Jr. --;

Column 1,
Line 17, delete "opeing" and replace with -- opening --;

Column 9,
Line 33, delete "connected to the two arms" and insert -- connected to the two arms -- after "pieces";
Line 34, insert -- a -- between "in" and "direction"; and
Line 35, delete "nieces" and replace with -- pieces --.

Signed and Sealed this

Eleventh Day of October, 2005

JON W. DUDAS
*Director of the United States Patent and Trademark Office*